US011332945B2

(12) United States Patent
Jarmey

(10) Patent No.: US 11,332,945 B2
(45) Date of Patent: May 17, 2022

(54) TILING SYSTEM FOR DECKING

(71) Applicant: Michael John Jarmey, Bournemouth (GB)

(72) Inventor: Michael John Jarmey, Bournemouth (GB)

( * ) Notice: Subject to any disclaimer, the term of this patent is extended or adjusted under 35 U.S.C. 154(b) by 0 days.

(21) Appl. No.: 16/980,947

(22) PCT Filed: Mar. 14, 2019

(86) PCT No.: PCT/GB2019/000047
§ 371 (c)(1),
(2) Date: Sep. 15, 2020

(87) PCT Pub. No.: WO2019/175528
PCT Pub. Date: Sep. 19, 2019

(65) Prior Publication Data

US 2020/0407983 A1 Dec. 31, 2020

(30) Foreign Application Priority Data

Mar. 16, 2018 (GB) ..... 1804341

(51) Int. Cl.
*E04F 15/10* (2006.01)
*E04F 15/02* (2006.01)
*E04F 15/024* (2006.01)

(52) U.S. Cl.
CPC ..... *E04F 15/105* (2013.01); *E04F 15/02172* (2013.01); *E04F 15/02183* (2013.01); *E04F 15/02476* (2013.01)

(58) Field of Classification Search
CPC ..... E04F 15/02194; E04F 15/02183; E04F 15/105; E04F 15/02172; E04F 15/02476; E04B 1/003; E04C 5/001; E04C 5/223
See application file for complete search history.

(56) References Cited

U.S. PATENT DOCUMENTS 4,226,064 A * 10/1980 Kraayenhof ..... A01K 1/015 404/35
5,546,717 A * 8/1996 Penczak ..... H02G 3/285 174/482

(Continued)

FOREIGN PATENT DOCUMENTS

DE 202016100973 U1 * 3/2016 ..... E04F 15/02194
GB 2330154 A 4/1999

(Continued)

*Primary Examiner* — Theodore V Adamos
(74) *Attorney, Agent, or Firm* — Richard M. Goldberg

(57) ABSTRACT

A tiling system for forming or covering a deck includes a plurality of lightweight tiles (formed of synthetic plastics material) and a like plurality of underlay units to be secured underneath the tiles with peripheral edges of the tiles mutually adjacent. The tiles and the underlay units are formed with respective non-adhesive connection means locating each tile on and centrally located with respect to a corresponding underlay unit. Projections extend from the edges of the underlay units to engage adjacent underlay units in use and to separate the edges of the tiles. Each tile is of lateral extent in each direction somewhat less than the lateral extent of the corresponding underlay unit, so that the tiles when connected to the underlay units have their edges mutually spaced apart with open gaps between them. The gaps between the tiles permit them to expand in hot weather without lifting or tenting.

19 Claims, 9 Drawing Sheets

(56) References Cited

U.S. PATENT DOCUMENTS 6,467,224 B1 * 10/2002 Bertolini ..... E04F 15/02194 52/177
8,539,727 B2 * 9/2013 Lui ..... E04F 15/02 52/384
2003/0089051 A1 * 5/2003 Bertolini ..... E01C 5/22 52/177
2005/0034403 A1 * 2/2005 Chen ..... E04F 15/105 52/578
2007/0094969 A1 * 5/2007 McIntosh ..... E04F 15/203 52/386
2008/0276567 A1 * 11/2008 Rap ..... E01C 9/086 52/792.11
2009/0217614 A1 * 9/2009 Cooper ..... E04F 15/10 52/582.1
2009/0266022 A1 * 10/2009 Lin ..... E01C 5/001 52/506.1
2010/0000163 A1 * 1/2010 Tsai ..... E04F 15/02452 52/126.6
2012/0117910 A1 * 5/2012 Chuang ..... G09F 15/0006 52/588.1
2013/0255175 A1 * 10/2013 Borowick ..... E04F 15/02044 52/580
2014/0007526 A1 * 1/2014 Wright ..... E04B 5/023 52/127.4
2016/0312490 A1 * 10/2016 McDowell ..... E01C 9/08
2016/0362902 A1 * 12/2016 Lee ..... E04F 15/02044
2017/0138065 A1 * 5/2017 Kugler ..... E04F 15/02494
2017/0298638 A1 * 10/2017 Bosman ..... E04F 15/02194
2018/0112417 A1 * 4/2018 Cipriani ..... E04F 15/02194
2020/0232227 A1 * 7/2020 McIntosh ..... E04F 15/087
2020/0340256 A1 * 10/2020 Lee ..... E04F 15/02044

FOREIGN PATENT DOCUMENTS

JP 2003301589 A * 10/2003 ..... E04F 15/02194
NL 1028881 C2 10/2007

* cited by examiner

TILING SYSTEM FOR DECKING

BACKGROUND OF THE INVENTION

This invention concerns a tiling system particularly but not necessarily exclusively for tiling decks or other pedestrian areas adjacent residential accommodation such as caravans, lodges and cabins on a leisure park.

In outdoor tiling it is important to allow for thermal expansion and contraction of the tiles as temperature varies, the temperature variation being greatest where the tiles are exposed to direct sunlight (which otherwise may be desirable in an environment like a leisure park). On roofs and vertical surfaces tiles are conventionally laid loosely in mutually overlapping courses with the lateral edges of the tiles slightly spaced apart from the proximal edges of tiles in the same course and their lower edges free. This allows for thermal expansion and contraction of the tiles. But such an arrangement is not appropriate for a pedestrian area where for reasons of safety the tiling needs to be firm and flat. In any event, to tile a pedestrian area with overlapping tiles would greatly increase the cost.

In paving it is known, of course, to lay tiles, setts or other paviours with gaps between them to receive a relatively soft grouting material such as sand that can absorb edge movements during thermal expansion or contraction. This is satisfactory as long as the paviours are heavy, but not so with lightweight tiles, which can lift or "tent" over time so that the tiles become uneven and possibly unsafe.

Rather than grouting, it has been proposed to join flooring or paving tiles together by means of resilient connectors, as described for example in Dutch patent NL1028881 (Vos Xander). This discloses square flooring sections that each sit in a kind of resilient tray with downward-facing lips on two sides and complementary upward-facing lips on the other two sides, with lips adjacent in use snapping together to hold the flooring sections in place. However, Vos Xander shows adjacent flooring sections closely abutting one another, so there is no room for thermal expansion.

SUMMARY OF THE INVENTION

It is an object of the present invention to provide tiling that allows for thermal expansion and contraction.

Thus according to a first aspect of the invention there is provided a tiling system for forming or covering a deck, which system comprises a plurality of tiles and a like plurality of underlay units to be secured underneath the tiles with peripheral edges of the tiles mutually adjacent, characterised in that:

the tiles are formed of synthetic plastics material;

the tiles and the underlay units are formed with respective non-adhesive connection means locating each tile on and centrally located with respect to a corresponding underlay unit;

projections extend from the edges of the underlay units to engage adjacent underlay units in use and to separate said edges of the tiles; and each tile is of lateral extent in each direction somewhat less than the lateral extent of the corresponding underlay unit, the located tiles thereby having edges mutually spaced apart with open gaps therebetween.

The open gaps between proximal edges of the tiles allow the tiles to contract or expand according to weather conditions, without tenting or other damage.

The invention extends to a tile for the filing system, decking formed from the tiling system and a method of making a deck or covering an existing deck by means of the tiling system.

BRIEF DESCRIPTION OF THE DRAWINGS

Other aspects of the invention will be apparent from the following description, which is made by way of example only with reference to the accompanying drawings which are purely schematic and in which—

DETAILED DESCRIPTION

Figure 1:
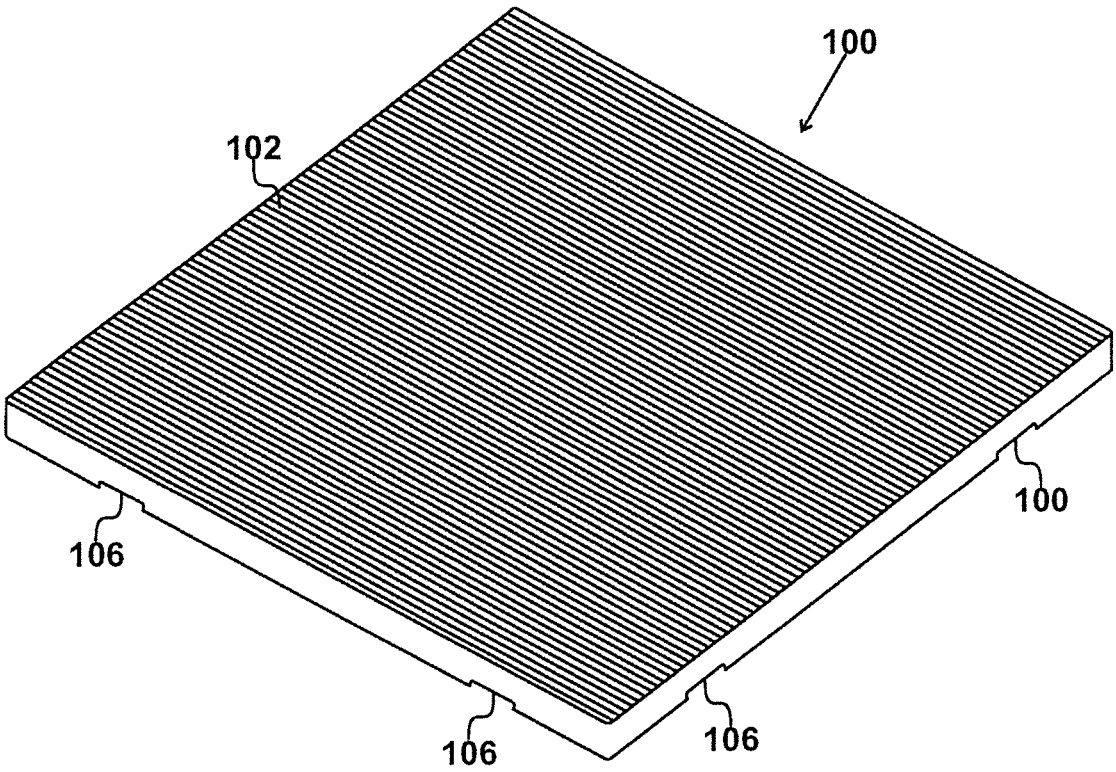
FIG. 1 is an isometric view of a tile being part of a tiling system according to the invention, as seen from above and one side.

Referring first to FIG. 1, the tile 100 shown therein is 400 mm square and 60 mm thick. It is moulded from acrylonitrile styrene acrylate (ASA) and its upper surface 102 has a non-slip finish formed during the moulding process.

Figure 2:
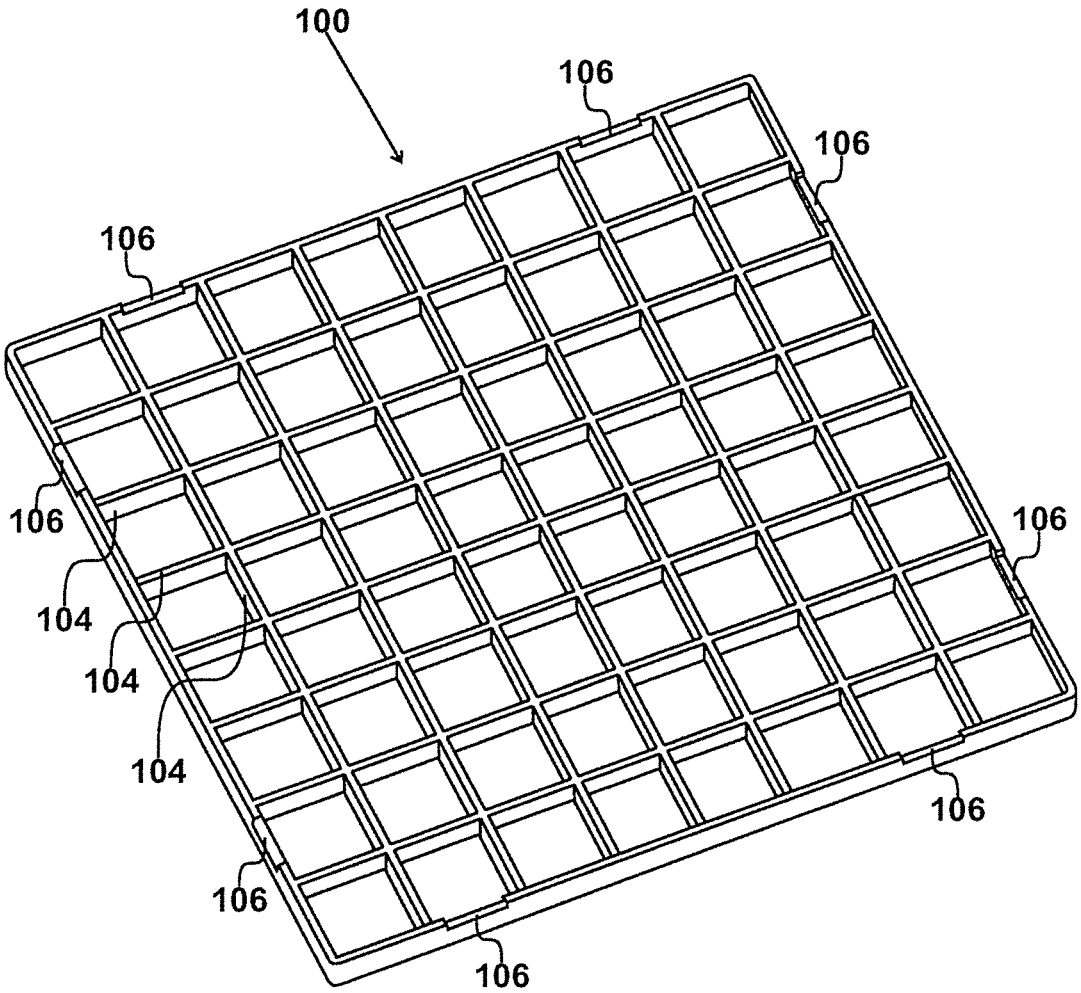
FIG. 2 is an isometric view of the underside of the tile of FIG. 1.

As shown in FIG. 2, the underside of the tile 100 is formed with a plurality of ribs indicated at 104. The ribs 104 extend laterally across the tile 100 between its opposed edges and are spaced at 50 mm centres to form a rectilinear grid. Each rib 104 has a cut-out 106 near each end. (For simplicity of illustration, not all of these recesses are numbered in FIG. 2).

Figure 3:
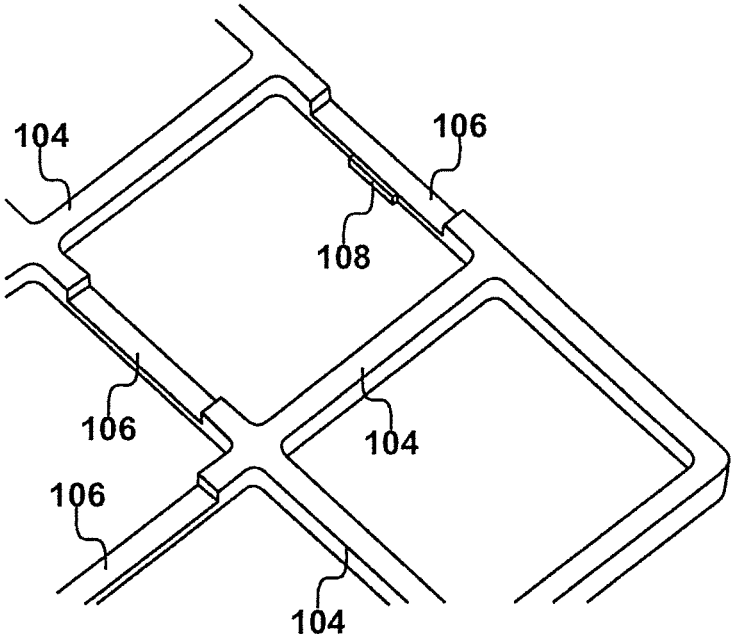
FIG. 3 shows part of FIG. 2, at a much increased scale.

The rib structure can be seen more easily in FIG. 3.

Figure 4:
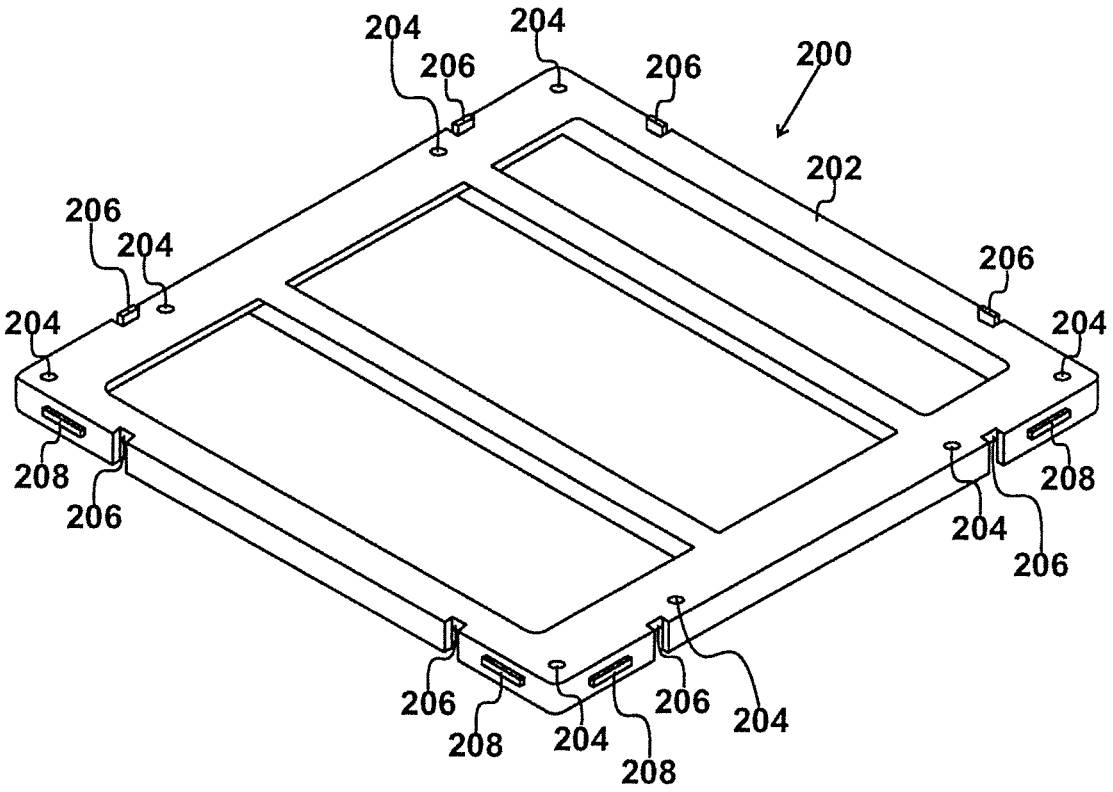
FIG. 4 is an isometric view of an underlay unit to carry the tile of FIGS. 1 to 3, as seen from above and to one side.
Figure 5:
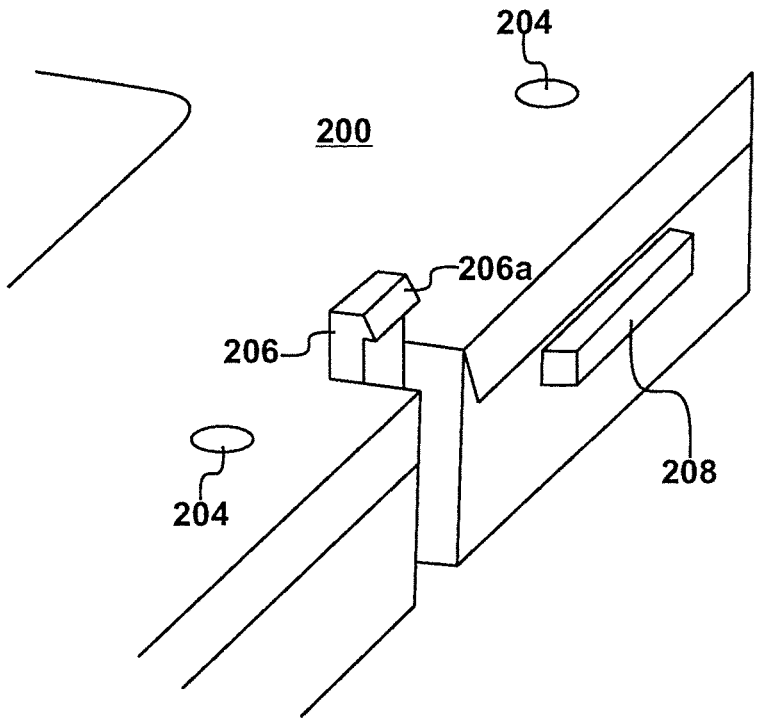
FIG. 5 shows part of FIG. 4, at a much enlarged scale.
Figure 6:
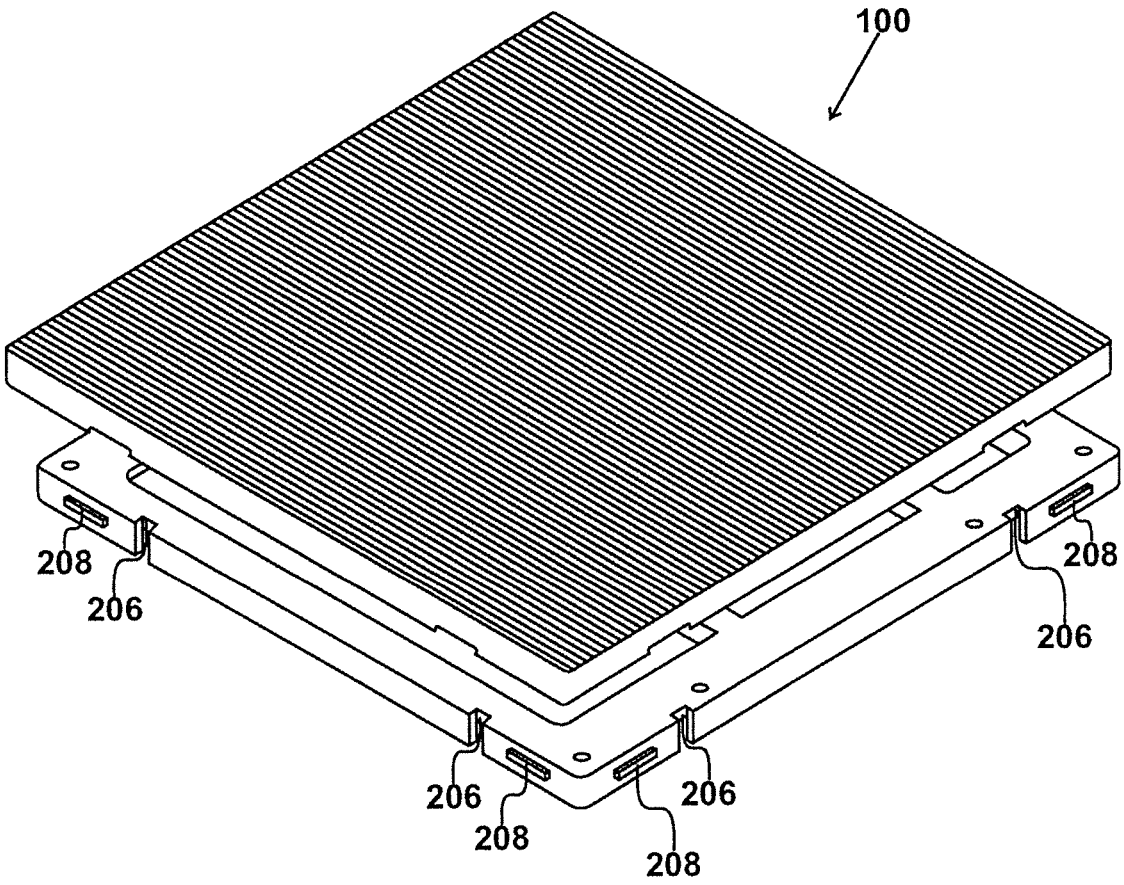
FIG. 6 is an isometric view of the tile of FIGS. 1 to 3 above the underlay unit of FIGS. 4 and 5 and ready to be connected thereto.

Referring now to FIG. 4, the underlay unit 200 shown therein is square like the tile 100 with a central portion 202 in the form of a framework of the same lateral dimensions as the tile, ie 400 mm square. The central portion 202 is preformed with holes 204 whereby the underlay unit may be secured to a supporting structure or an existing deck (not shown) by means of screws (also not shown). Teeth 206 extend vertically from the underlay unit and are each formed (as seen more clearly in the enlarged view of FIG. 5) with a laterally extending spur 206*a* that has snap-fit engagement in a recess 108 in the underside of the tile 100 when (as seen in FIG. 6) the tile 100 is to be connected to an underlay unit 200.

The underlay unit 200 is formed from glass-reinforced nylon and therefore each tooth 206 has a degree of resilience that allows the tiles 100 to contract laterally in cold weather, even though they remain firmly connected to the secured underlay units 200.

Projections 208 extend laterally on each side of the central portion 202 of the underlay unit 200 so that the overall lateral extent of the underlay unit 200 is somewhat greater than that of the tile 100. The teeth 206 and recesses 108 are configured and arranged to locate a tile 100 centrally with respect to a corresponding underlay unit 200. And, each projection 208 having a lateral extent of 1.5 mm, the result is that proximal edges of tiles 100 when laid are 3.0 mm apart.

This spacing is enough to permit laid tiles 100 to expand in hot weather without tenting, buckling or the like, even though they remain firmly connected to the secured underlay units 200.

Figure 7:
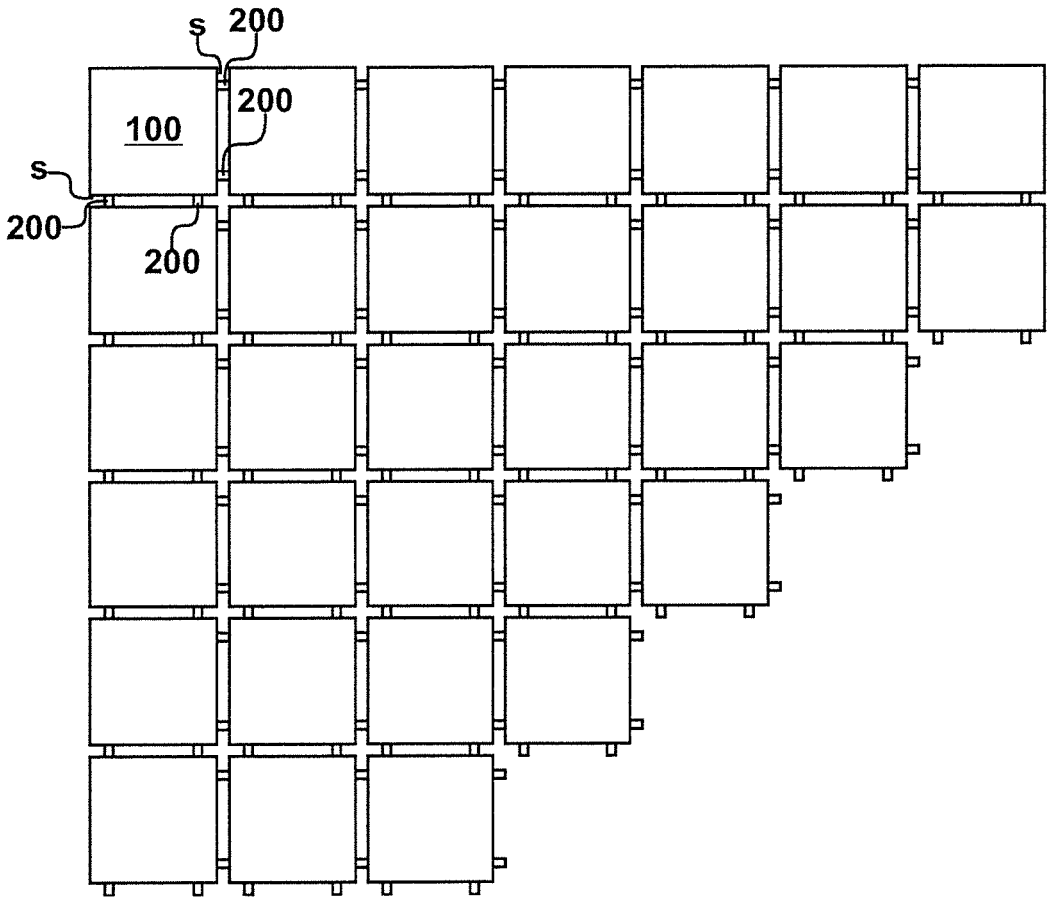
FIG. 7 shows a plurality of tiles 100 being laid to form a deck with proximal edges of the tiles 100 being spaced apart by a distance s to permit thermal contraction.

FIG. 7 shows a plurality of tiles 100 being laid to form a deck, the tiles 100 being spaced apart by a distance s (=3.0 mm) to permit thermal expansion in hot weather. The spacing s is provided by the abutment of the projections 208 extending laterally from the underlay units (not visible in FIG. 7) that carry the tiles 100. Underlay units 200 to carry tiles 100 may be laid on a decking substructure, which preferably has a modular pitch equal to the lateral dimensions of the tiles and may comprise adjustable pedestals such as those supplied by Castle Composites Limited of Lanark, Scotland. Otherwise an existing deck may be covered (eg for weather protection) by underlay units 200 carrying tiles 100.

[It should be noted that, for simplicity of illustration, only the elements at the top left of FIG. 7 have been numbered, and the dimensions of the projections 208 and the spaces s have been exaggerated.]

Figure 8:
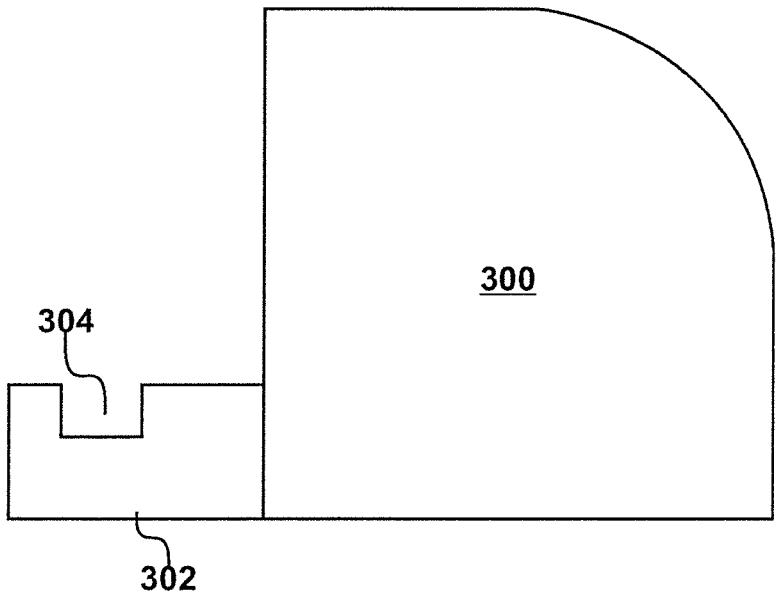
FIG. 8 illustrates in cross-section an edging piece for tiling according to the invention.

To finish off a deck and to protect its outer edges, edging pieces 300 as shown in FIG. 8 may be laid. Each edging piece 300 has a curved profile with a projecting tongue 302 cut away at 304 to sit under a recess 106 of a tile 100 so that in use the edging piece 300 is held in place.

Figure 9:
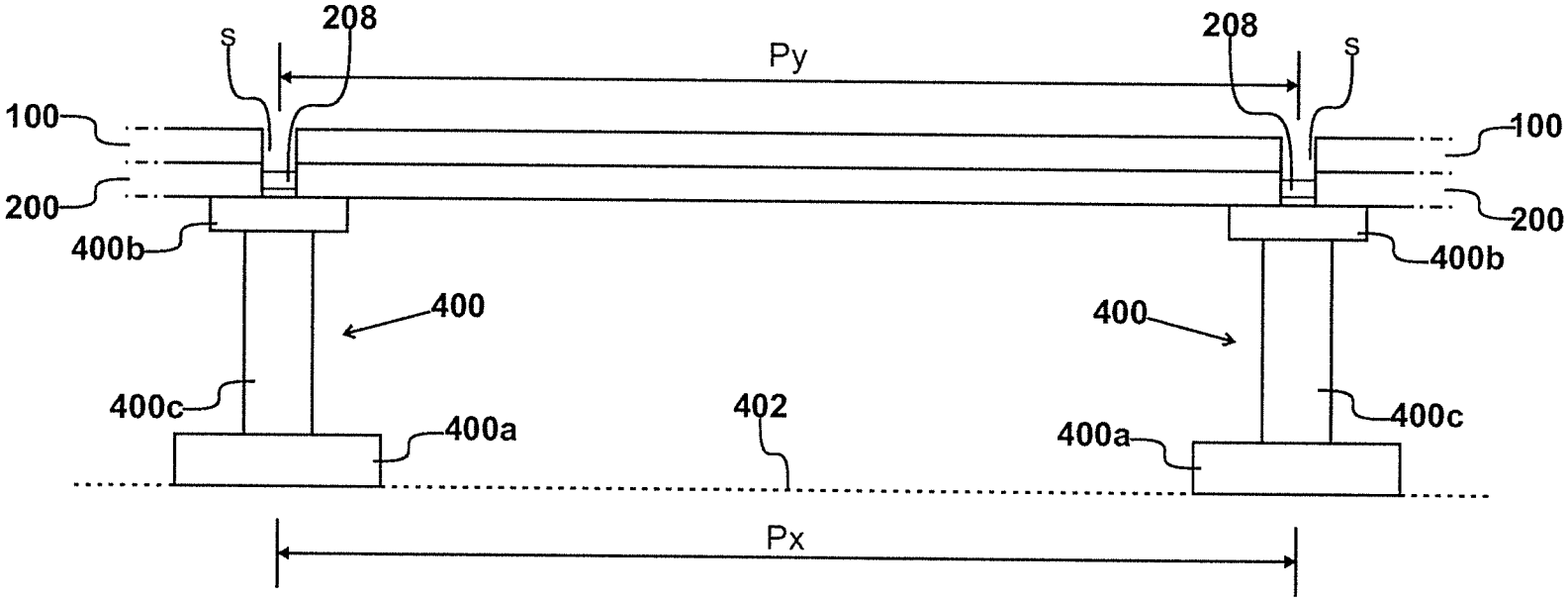
FIG. 9 illustrates in side elevation a tiling system according to the invention including a supporting structure.

FIG. 9 illustrates a tiling system according to the invention which includes a supporting structure for the tiles. Thus, as shown in FIG. 9, tiles 100 are connected non-adhesively to underlay units 200 in the manner hereinbefore described, with gaps s between adjacent edges of the tiles 100 provided by lateral projections 208 of the underlay units 200. (It is to be understood that the tiles 100 extend in each direction to form a deck, as indicated by the broken lines extending from the left and the right tiles 100 shown in FIG. 9. In addition, the gaps s and the projections 208 are shown exaggerated in FIG. 9).

The underlay units 200 are carried by a supporting structure comprising pedestals 400 mutually spaced apart by a pitch Px equal to the pitch Py of the tiles 100.

Each pedestal 400 has a base 400*a* that rests on the ground 402. Each underlay unit 200 sits on and is secured to the head 400*b* of a pedestal 400 so that the tiles 100 are raised from the ground 402 to form a deck. A screw mechanism 400*c* between the base 400*a* and head 400*b* of each pedestal 400 enables the head 400*b* to be raised or lowered relative to the base 400*a*, and by this means a deck formed by the tiles 100 can be levelled notwithstanding a slope or irregularity of the ground 402.

It will now be understood that the invention provides a substantial improvement in decking construction (and possibly other tiling installations) in allowing thermal expansion and contraction without deleterious effects. It should also be noted, however, that the invention offers another substantial benefit of particular value to do-it-yourself (DIY) builders. At present decking is almost universally made using boards that are long (up to 4800 mm) and heavy and therefore not easily carried home by many domestic users. By contrast, tiles and underlay units as proposed herein are merely 400 mm or so square and weigh about 1 kg so several boxes of say ten each can readily be accommodated in a family car after purchase at a DIY store.

The invention claimed is:

1. A tiling system for forming or covering a deck, wherein said system comprises:

a plurality of n tiles;

a plurality of n underlay units to be secured underneath the tiles with peripheral edges of the tiles mutually adjacent and spaced apart with open gaps between the peripheral edges of the tiles; and a non-adhesive securing arrangement for securing the underlay units to a supporting structure, wherein:

the tiles are formed of synthetic plastics material;

each said underlay unit has outer peripheral lateral edges in each direction which are in alignment with the peripheral edges of each said tile;

the tiles and the underlay units are formed with a respective connection arrangement comprising resilient teeth engaging in corresponding recesses configured and arranged to locate each tile centrally and in alignment with a corresponding underlay unit, the resilience of the teeth allowing each said tile to expand and contract laterally as temperature varies while remaining connected to the underlay unit secured underneath the respective said tile, wherein the teeth are positioned inwardly from a respective outer peripheral lateral edge of the underlay units and comprise a laterally extending spur that extends towards the respective outer peripheral lateral edge so as to be configured to snap-fit engage a respective recess of the tiles; and projections extend laterally from each of the outer peripheral edges of each adjacent underlay unit to prevent expansion of the underlay units, in use thereby to mutually separate the adjacent outer peripheral edges of the underlay units, and hence mutually separate edges of the tiles connected respectively to the underlay units to form said open gaps.

2. A tiling system as claimed in claim 1 further comprising a said supporting structure to which said tiles are secured by said non-adhesive securing arrangement.

3. A tiling system as claimed in claim 2 wherein each underlay unit is preformed with holes for securing each underlay unit to said supporting structure by screws.

4. A tiling system as claimed in claim 2 wherein said supporting structure comprises a plurality of vertically adjustable pedestals.

5. A tiling system as claimed in claim 1 wherein the tiles are formed from ASA.

6. A tiling system as claimed in claim 1 wherein the underlay units are formed from glass-reinforced nylon.

7. A tiling system as claimed in claim 1, wherein each said tile has a substantially planar upper surface in use and an underside formed with a plurality of rectilinearly-arranged ribs configured and arranged to receive the laterally extending spurs on the teeth of an underlay unit.

8. A tiling system as claimed in claim 7 wherein the upper surface of each tile in use has a non-slip finish.

9. Decking comprising a tiling system as claimed in claim 2 wherein said supporting structure comprises supports regularly spaced apart at a pitch equal to a lateral pitch of the tiles.

10. A tiling system for forming or covering a deck, wherein said system comprises:

a plurality of n tiles;

a plurality of n underlay units to be secured underneath the tiles with peripheral edges of the tiles mutually adjacent and spaced apart with open gaps between the peripheral edges of the tiles; and a non-adhesive securing arrangement for securing the underlay units to a supporting structure, wherein:

the tiles are formed of synthetic plastics material;

each said underlay unit has outer peripheral lateral edges in each direction which are in alignment with the peripheral edges of each said tile;

the tiles and the underlay units are formed with a respective connection arrangement comprising resilient teeth engaging in corresponding recesses configured and arranged to locate each tile centrally and in alignment with a corresponding underlay unit, the resilience of the teeth allowing each said tile to expand and contract laterally as temperature varies while remaining connected to the underlay unit secured underneath the respective said tile; and projections extend laterally from each of the outer peripheral edges of each adjacent underlay unit to prevent expansion of the underlay units, in use, outermost free ends of the projections of adjacent underlay units abut one another to thereby mutually separate the adjacent outer peripheral edges of the underlay units, and hence mutually separate edges of the tiles connected respectively to the underlay units to form said open gaps.

11. A tiling system as claimed in claim 10 further comprising a said supporting structure to which said tiles are secured by said non-adhesive securing arrangement.

12. A tiling system as claimed in claim 11 wherein each underlay unit is preformed with holes for securing each underlay unit to said supporting structure by screws.

13. A tiling system as claimed in claim 11 wherein said supporting structure comprises a plurality of vertically adjustable pedestals.

14. A tiling system as claimed in claim 10 wherein the resilient teeth extend vertically from one of each said underlay unit and each tile to be received in corresponding recesses in the other of each underlay unit and each tile so as to locate each tile on and centrally of a corresponding underlay unit.

15. A tiling system as claimed in claim 14, wherein each said tile has a substantially planar upper surface in use and an underside formed with a plurality of rectilinearly-arranged ribs configured and arranged to receive laterally extending spurs on the teeth of an underlay unit.

16. A tiling system as claimed in claim 15 wherein the upper surface of each tile in use has a non-slip finish.

17. A tiling system as claimed in claim 10 wherein the tiles are formed from ASA.

18. A tiling system as claimed in claim 10 wherein the underlay units are formed from glass-reinforced nylon.

19. Decking comprising a tiling system as claimed in claim 11 wherein said supporting structure comprises supports regularly spaced apart at a pitch equal to a lateral pitch of the tiles.

* * * * *